United States Patent [19]

Bühler

[11] Patent Number: 4,785,589

[45] Date of Patent: Nov. 22, 1988

[54] PROCESS FOR MEASURING AND GRINDING THE PROFILE OF A RAIL HEAD

[75] Inventor: Fritz Bühler, Ecublens, Switzerland

[73] Assignee: Les Fils d'Auguste Scheuchzer S.A., Lausanne, Switzerland

[21] Appl. No.: 948,031

[22] Filed: Dec. 31, 1986

[30] Foreign Application Priority Data

Feb. 28, 1986 [CH] Switzerland ..... 00837/86

[51] Int. Cl.[4] ..... B24B 49/04

[52] U.S. Cl. ..... 51/178; 51/281 R

[58] Field of Search ..... 51/178, 281 R; 364/474

[56] References Cited

U.S. PATENT DOCUMENTS 4,050,196 9/1977 Theurer ..... 51/178

4,115,857 9/1978 Panetti ..... 51/178

FOREIGN PATENT DOCUMENTS 44885 2/1982 European Pat. Off. .

2701216 8/1977 Fed. Rep. of Germany .

*Primary Examiner*—Roscoe V. Parker

*Attorney, Agent, or Firm*—Robert E. Burns; Emmanuel J. Lobato

[57] ABSTRACT

By means of several measuring sensors (C1 to C6), the distance (h1 to h6) from several generatrices (s1) to s6) of the rail-head profile to a reference base are measured and are compared as actual values with predetermined desired distance values. The grinding heads, which are set to a specific generatrix and which grind a facet at an angle of inclination corresponding to the position of each generatrix, are always lifted off automatically when this facet reaches the position corresponding to the desired distance value in relation to the reference base. Because the distance to a particular generatrix, on which is located the vertex line of two adjacent facets of a pair of facets, is measured as an actual value, any two adjacent facets can be checked simultaneously by means of one and the same measuring sensor (C1 to C6). The two facets of a pair of facets are ground by means of a double grinding head set to the vertex line and having two grinding wheels, the grinding planes of which form a predetermined working angle ($\alpha$) with one another which corresponds to the desired profile. The control of the grinding heads therefore merely involves a simple comparison between desired values and actual values of distances; furthermore, double the number of facets can be checked by means of a specific number of measuring sensors, and consequently the rail profile can be approximated as closely as possible.

15 Claims, 6 Drawing Sheets

PROCESS FOR MEASURING AND GRINDING THE PROFILE OF A RAIL HEAD

FIELD OF THE INVENTION

The invention relates to a process for measuring and grinding the profile of a rail head and to a rail-grinding car for carrying out the process.

PRIOR ART

Such a process and such a rail-grinding car are already known from German Auslegeschrift No. 2,701,216. This known process is based essentially on the following steps:

The mean amplitude of the short rail waves, the amplitude of the long rail waves, the extent of the errors in the rail-head profile and the like are measured as quantities which characterize the state of the rail head, and these quantities are determined in a measured-value circuit from measurement data supplied by sensors sensing the rail profile. The signals corresponding to these quantities are fed to a computer, in which the known values for the working capacity of the grinding tools, such as, for example, the grinding pressure, the machining speed, the angle of inclination of the grinding tools and the advancing speed along the rail, are also entered. This computer is designed so that according to a stored computing program it transmits signals which correspond to the desired values for the various working data of the grinding tools. These desired values are fed to control circuits which control the grinding tools accordingly. In this procedure, the quantities characterizing the state of the rail head are measured both before remachining and after remachining by means of two test rigs which are arranged at the front end and at the rear end of the rail-grinding car. Corrections are made as a result of the second measurement carried out after remachining.

This process and the computing and control circuits necessary for carrying it out are obviously fairly complicated. Moreover, the desired profile of the rail head has to be approximated by controlling, during machining, in particular the grinding pressure, the grinding speed, the angle of inclination of the grinding tool and the advancing speed along the rail, these working quantities being dependent on a specified desired value which itself is determined as a function of the machining depth. The information given in the said publication does not indicate when exactly the grinding work has to be interrupted, so that the desired profile is approximated as closely as possible along one or more generatrices, nor does it give any relations between the generatrices, to which the measuring sensors are set, and those generatrices to which one or more grinding tools are set for the purpose of grinding an appropriate facet.

According to the process for measuring a rail-head profile described in the published European Patent Application No. 44,885, the distances from the two generatrices limiting the rail running surface and an intermediate middle generatrix to a reference base are determined, in order to obtain from these the curvature of the rail running surface. For this purpose, the height of camber of the profile arc of the rail running surface at the location of the middle generatrix and on the other hand the inclination of the chord connecting the two outer generatrices in relation to the track plane are determined from the three measured distances. Electronic measuring sensors are used for the measurement, and these operate without contact, for example capacitively, optically or on the eddy-current principle.

In another known rail-grinding car (published European Patent Application No. 32,214), the vertically adjustable grinding-head carriers, on each of which are installed several grinding tools, can be set angularly relative to the underframe in a plane oriented perpendicularly to the track axis, and moreover each grinding tool can be pivoted individually relative to the grinding-head carrier and can be pressed against the rail at a specific angle of inclination.

A known device for the continuous measurement of a rail-head profile (published European Patent Application No. 114,284) has a plurality of rail tracers which are designed and installed in a space-saving way.

SUMMARY OF THE INVENTION

The object on which the invention is based is to simplify and organize the measurement and remachining of rail-head profiles, so that the desired profile can be approximated more exactly than hitherto by means of relatively simple control devices.

The essential advantages are that, according to the invention, the actual profile is simply characterized by the directly measured distances on a sufficient number of generatrices, without these direct measurement data needing to be converted or changed into other quantities, such as, for example, the angle of inclination, the height of camber or the like; likewise, machining until the desired profile is obtained is controlled merely by means of the comparison between the actual distances and the predetermined desired distances which is easy to carry out electronically, as a result of which the desired profile can be approximated as closely as possible in a simple and direct way, because the grinding operation on each generatrix is automatically interrupted when the difference between the desired distance and the actual distance disappears.

It is preferable in the distance measurement to proceed by measuring the distance from a vertex line of two adjacent facets of a particular pair of facets to the reference base as an actual value and comparing it with the predetermined desired distance between this vertex line and the reference base, and by grinding the two facets of this pair of facets by means of a double grinding head set to the vertex line and having two grinding wheels, the grinding planes of which form a predetermined working angle with one another which corresponds to the desired profile. This gives rise to the further advantage that two facets can be measured and checked simultaneously by means of a single measurement, that is to say a single measuring sensor, so that double the number of facets is checked by means of a given number of sensors and consequently the desired profile can be approximated particularly closely because of the larger number of facets.

BRIEF DESCRIPTION OF THE DRAWINGS

The invention is explained in detail by means of the drawings with reference to an exemplary embodiment. In the drawings.

DESCRIPTION OF THE PREFERRED EMBODIMENT

Figure 1:
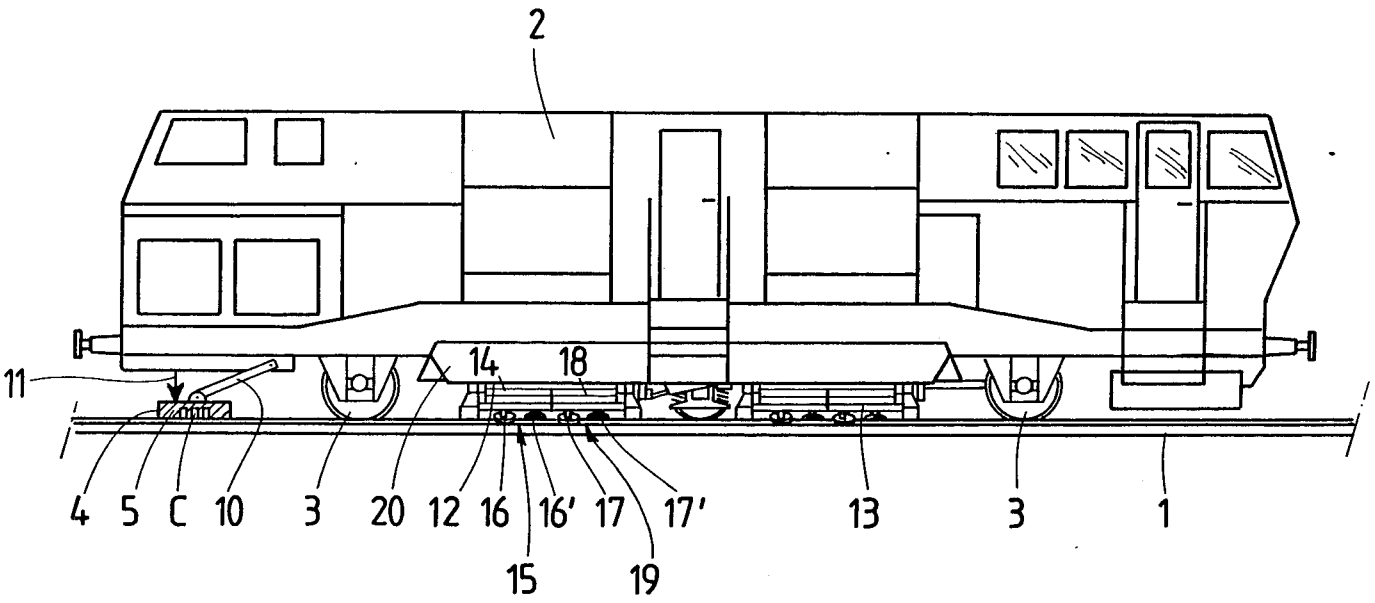
FIG. 1 shows a side view of a rail-grinding car according to the invention.
Figure 2:
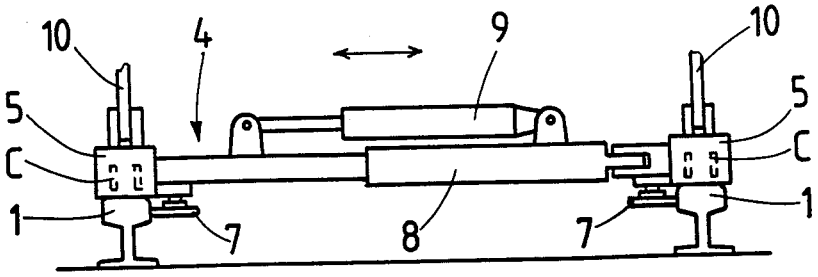
FIG. 2 shows a view of the test rig, as seen transversely relative to the track.

According to FIG. 1, a rail-grinding car 2 movable on the track 1 by means of its two underframes 3 is equipped at one end with a measuring frame 4. As shown diagrammatically in FIG. 2, this test rig 4 has, for each rail 1, a measuring head 5, to which are fastened several non-contact measuring sensors C. In the example according to FIG. 3 under consideration, seven sensors C1 to C7 are provided for each measuring head 5. The two measuring heads 5 are supported by means of sliding blocks 6 on the center of the rail 1 and are connected to the rail-grinding car 2 by means of tie rods 10 attached in an articulated manner. The two measuring heads 5 are guided by lateral rollers 7; these roll on the inner faces of the rails 1 and, as indicated by the double arrow, are constantly pressed against the rails 1 by means of a spreader device 8 which is installed between the two measuring heads 5 and which is stressed by a hydraulic piston 9.

Furthermore, a hydraulic system, indicated merely diagrammatically in FIG. 1 by the arrow 11, which is suspended on the chassis of the rail-grinding car 2 and which acts on the two measuring heads 5 ensures that the sliding blocks 6 constantly rest on the rails 1 with sufficient force. This guarantees that, when the rail-grinding car 2 advances, each sensor C follows a specific generatrix of the rail head.

Figure 3:
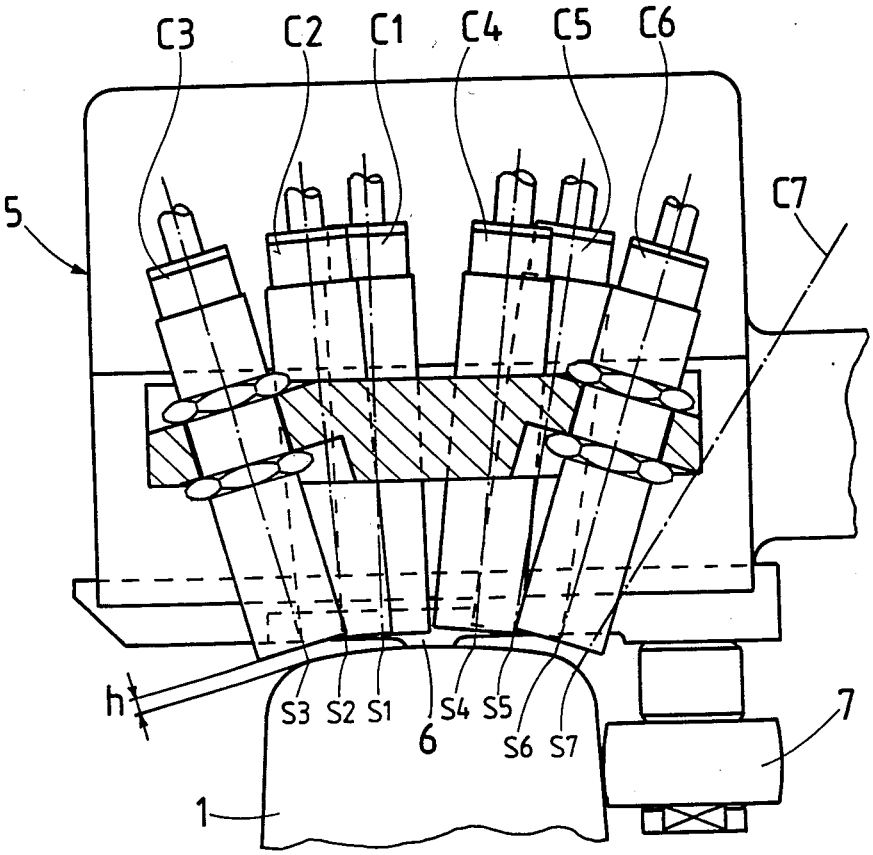
FIG. 3 shows a diagrammatic representation of the sensors of a measuring head.

According to FIG. 3, the axes of the sensors C1 to C6 are aligned with six generatrices s1 to s6. These six predetermined generatrices are distributed approximately uniformly over the region of the rail running surface which extends along a mid-arc of the rail-head profile. This mid-arc has a relatively large radius, typically of approximately 300 mm, and the radii drawn from the center of this arc to the arc ends each form an angle of approximately 15° with the mid-perpendicular, that is to say the radius running through the center of the rail head.

In the example according to FIG. 3, there is also a seventh sensor C7 which is indicated only by its axis and which is set to a generatrix s7. As explained in more detail later with reference to FIGS. 6, 8 and 9, this sensor C7 serves for measuring the lap, generally occurring on the outside of the rail, and the outer arc of the rail 1; this outer arc is also frequently designated as the outer radius.

The sensors C are, for example, inductive measuring instruments. Each sensor C is designed to measure the distance h to that generatrix to which it is set. At the same time, the test rig 4 supported on the rail center by means of its sliding blocks 6 forms a reference base in relation to which the distances h are measured continuously. In the example according to FIG. 3 under consideration, the reference points of this base are the lower ends of the sensors C.

The rail-grinding car 2 is equipped, between its two underframes 3, with two grinding units 12 and 13 for each rail 1, these being suspended on the car chassis 20 in the known way and being supported on the rails. Each grinding unit 12 and 13 has two grinding-head carriers 14 and 18 which each carry a double grinding head 15 and 19 with two grinding heads 16, 16′ and 17, 17′, as indicated diagrammatically in FIG. 1 with regard to the grinding unit 12.

Figure 4:
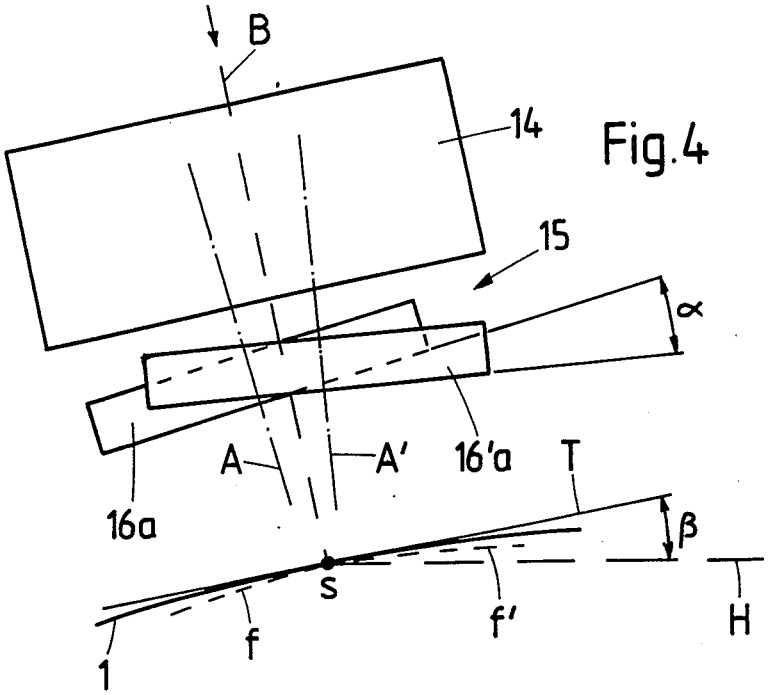
FIG. 4 shows a diagrammatic representation of a double grinding head with its two grinding wheels.

In a way known per se, each grinding-head carrier 14 and 18 is pivotable and vertically adjustable in a plane oriented perpendicularly relative to the track axis. FIG. 4 shows diagrammatically the grinding-head carrier 14 in the state in which it is lifted off from the rail 1. It can be tilted through a specific angle of inclination $\beta$ and aligned by means of its center axis B with a predetermined generatrix s and is movable up and down in the direction of the double arrow.

In the example according to FIG. 4, the angle of inclination $\beta$ is the angle which the horizontal H forms with that tangent T which is drawn to the head profile of the rail 1 and which passes through the generatrix s intersecting the center axis B of the grinding-head carrier 14. For geometrical reasons, this angle of inclination $\beta$ is of course equal to that angle which the radius of the head-profile arc leading to the generatrix s forms with the mid-perpendicular of the rail.

Moreover, on each grinding-head carrier 14, 18 the two grinding heads 16, 16′ and 17, 17′ can be pivoted individually in a plane likewise oriented perpendicularly relative to the rail axis and can be adjusted in the direction of their axes of rotation. In this way, the two grinding heads of each grinding-head carrier 14, 18 can be adjusted relative to one another, so that their two grinding planes intersect at a predetermined working angle $\alpha$, as indicated diagrammatically in FIG. 4 as regards the grinding-head carrier 14. There, the two grinding wheels 16*a* and 16*a*′ of the two grinding heads 16 and 16′ are shown with their axes of rotation A and A′, their two grinding planes forming the working angle $\alpha$. This double grinding head 15 produces the two facets f and f′ simultaneously during one operation, as indicated by broken lines in FIG. 4.

The angle of inclination $\beta$ of the grinding-head carrier does not necessarily need to be defined in relation to the inclination of the bisecting line of the angle formed by the axes of rotation A and A′ of the grinding heads or in relation to the center axis B of the grinding-head carrier, but can also relate to another reference line of the latter, for example to the axis of rotation of one of the grinding heads 16 or 16′, above all when this grinding head is mounted fixedly relative to the grinding-head carrier and only the other grinding head is adjustable relative to the grinding-head carrier for the purpose of setting the working angle $\alpha$. In this case, the angle of inclination of the double grinding head coincides with that of the first grinding wheel and consequently of the respective facet.

Figure 4A:
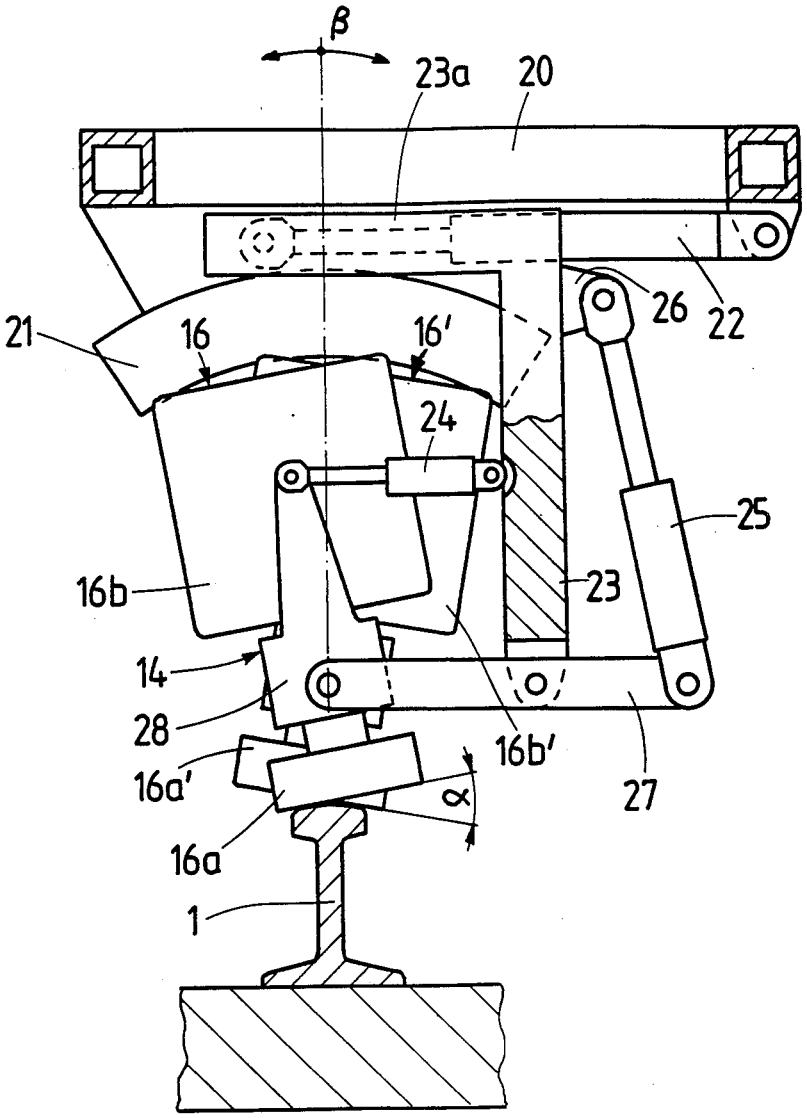
FIG. 4*a* shows diagrammatically a constructive design of a double grinding head.

FIG. 4*a* shows diagrammatically the constructive design of a double grinding head with the grinding-head carrier 14, on which the two grinding heads 16 and 16′ with their drive motors 16*b* and 16′*b* and their grinding wheels 16*a* and 16′*a* are mounted in series. The grinding-head carrier 14 is essentially composed of carrier parts, to which the grinding heads 16 and 16' are fastened and of which the carrier part 28 of the grinding head 16 can be seen in FIG. 4*a*, of a carrier 23 with a L-shaped cross-section, of a lever arm 27 connecting the lower ends of the carrier part 28 and of the frame 23 in an articulated manner, and of an adjusting cylinder 24 which is articulated on the one hand on the upper end of the carrier part 28 and on the other hand in the middle region of the frame 23. The frame 23 is suspended on the chassis 20 of the rail-grinding car 2, specifically in such a way that its upper part 23*a* is supported on a guide segment 21 fastened to the chassis 20 and is mounted on this so that it can shift or roll along the segment arc.

The lever arm 27 is extended beyond the point of articulation on the frame 23 and at its end facing away from the carrier part is articulated on the underside of a pneumatic cylinder 25. This pneumatic cylinder 25, the upper end of which is articulated on a projection 26 connected firmly to the frame 23, serves for relieving the double grinding head and for adjusting the grinding force with which the grinding wheels 16*a* and 16'*a* rest against the head of the rail 1. To lift them off, the piston of the pneumatic cylinder 25 is extended, with the result that the lever arm 27 is pivoted about its point of articulation on the frame 23 in the clockwise direction according to FIG. 4*a* and at the same time lifts the carrier part 28 together with the to grinding heads off from the rail 1. Conversely, when the piston of the pneumatic cylinder 25 is retracted, the grinding wheels 16*a* and 16'*a* are pressed against the rail 1.

To pivot the entire double grinding head, that is to say to set an angle of inclination $\beta$, there is an adjusting cylinder 22 which is articulated on the one hand on one side of the chassis 20 and on the other hand on the upper part 23*a* of the frame 23. When this adjusting cylinder 22 is actuated, the upper part 23*a* of the frame 23 moves along the arc of the guide segment 21, the frame 23 being pivoted about its point of articulation on the lever arm 27 and at the same time taking up the carrier part 28 by means of the adjusting cylinder 24. In this, the adjusting cylinder 24 merely functions as a rigid connection between the frame 23 and the carrier part 28 which itself tilts, together with the grinding head 16, about its point of articulation on the lever arm 27. In the example under consideration, it is assumed that the carrier part of the other grinding head 16' located behind the grinding head 16 is attached fixedly to the frame 23. Consequently, when the frame 23 is pivoted, the two grinding heads are taken up jointly, specifically the grinding head 16' directly and the grinding head 16 via the adjusting cylinder 24.

To set the working angle $\alpha$ between two grinding wheels 16*a* and 16'*a* or between the two facets to be generated by these grinding wheels, in the example under consideration only the first grinding head 16 is adjusted by means of the adjusting cylinder 24 relative to the other grinding head 16', of which the position in relation to the frame 23 is fixed and invariable. The working angle $\alpha$ is preferably adjustable between 0° and 10°, specifically either continuously or in steps. Where the machining of the rail running surface is concerned, these can be, for example, the three angles 1°, 2° and 4°.

The arrangement can also be such that each of the two grinding heads 16 and 16' can each be adjusted individually relative to the frame 23 by means of an adjusting cylinder corresponding to the adjusting cylinder 24.

Furthermore, the arrangement can be such that an individual pneumatic cylinder 25 for relief and for adjusting the grinding force is assigned to each of the two grinding heads 16 and 16' of a double grinding head, so that the grinding force of the two grinding heads can be adjusted independently of one another. The carrier part of each grinding head is then connected to the associated pneumatic cylinder 25 by means of separate lever arms 27.

When more than one pair of grinding heads are installed on a common grinding-head carrier 14, then appropriately all the grinding heads which machine one and the same facet, that is to say which are all set to a common facet inclination angle, can be articulated on a common pneumatic cylinder, so that they work with the same grinding force.

To make it possible to approximate the desired profile of the rail head as closely as possible during remachining, the actual profile in the region of the rail running surface should be measured and checked in terms of at least six generatrices and the complete profile in terms of at least 14 generatrices. The machining of the rail running surface is explained first below.

If six sensors set appropriately to six generatrices are provided for measuring and checking the rail running surface, and if, as seems obvious, a facet is cut along each generatrix, the running-surface profile would be approximated by six facets. However, that is usually insufficient. It is often necessary to approximate the rail running surface by at least 12 facets, each with the width of 4 to 5 mm, so that the vertices occurring between adjacent facets after grinding are not too pronounced and are therefore levelled off relatively quickly by the traffic rolling over them.

But it is now advantageously possible to double the number of facets to be checked, whilst maintaining a constant number of sensors, if a sensor does not measure the distance to the center of a facet, but instead the distance to the vertex line of two adjacent facets of a pair of facets. In particular, at a predetermined working angle $\alpha$ between the grinding wheels which generate adjacent facets, it is directly possible to define and predetermine that desired distance between the sensor and the vertex line of two facets at which the two facets approximate the desired profile as closely as possible, in particular lie in tangential planes to the desired profile. The double grinding heads 15, 19 already described, in which the two grinding heads can be set to the particular desired working angle $\alpha$, are provided for this reason.

The arrangement on the rail-grinding car is therefore such that a particular sensor C and the center axis B of one of the grinding-head carriers 14, 18 are set to one and the same generatrix s which then coincides with the vertex line of the two adjacent facets ground by the two grinding wheels of this double grinding head. Consequently, a single sensor C measures and checks the position of two facets simultaneously, so that by means of a given number of sensors, in the example under consideration six sensors, the desired profile of the rail running surface is approximated by double the number of facets, in the example under consideration twelve facets.

Figure 5:
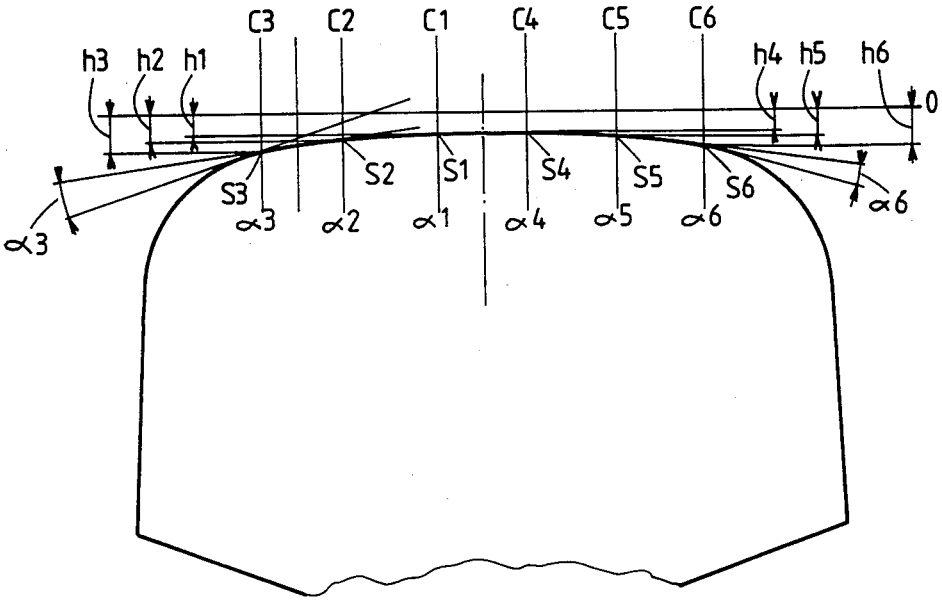
FIG. 5 shows a cross-section through a rail with information illustrating the measurement and machining of the running surface of a rail.

FIG. 5 illustrates diagrammatically the checking of the profile of the rail running surface by means of six sensors C1 to C6 which are aligned with the generatrices s1 to s6 and which constantly measure the distances h1 to h6 between them and the reference line O before and during the grinding operation. This reference line O, which is determined by the lower sensor ends defining the reference base, is represented by a horizontal straight line in FIGS. 5, 6, 8 and 9 for the sake of simplicity. The six generatrices s1 to s6 coincide with the vertex lines of two adjacent facets which are jointly ground respectively by the two grinding discs 16, 16' of a double grinding head 15 (FIG. 4). At the same time, the two grinding planes of each double grinding head form a predetermined angle $\alpha$1 to $\alpha$6 matched to the desired profile. Since a specific angle of inclination $\alpha$ is predetermined for each selected generatrix s, the arrangement can preferably be such that the two grinding wheels of a grinding-head carrier, when the latter is aligned with a specific generatrix, are set automatically to the working angle o corresponding to this generatrix.

The inner arc and the outer arc of each rail, also called the inner radius and outer radius by the experts, can, in principle, likewise be checked by means of the sensors described. However, each of these arcs, which have a substantially smaller radius than the mid-arc forming the rail running surface, should be checked by at least four sensors, so that altogether at least 14 sensors for each stretch of rail would be required to measure the complete profile. Consequently, it is generally advantageous to check and machine the inner and outer arcs by another process with a grinding device such as that described in the European Patent Application bearing publication number 125,348 of the same applicant. This known grinding device works with direct checking and control of the grinding heads. At the very least, it is recommended to machine the inner arc of the rails, which guides the flanges of the wheels, by this other known process.

It is also possible, however, to machine the outer arc, generally having more or less pronounced lapping after a relatively long traffic time, and if appropriate also the inner arc by the process and by means of a machine according to the present invention. As regards the inner arc or inner radius which extends over a large angular sector and which should be machined fairly accurately, at least four sensors must then be used for checking. In contrast, when the outer arc or outer radius is machined, it is advantageously possible to work with only a single sensor in the lap region, as explained below.

Figure 6:
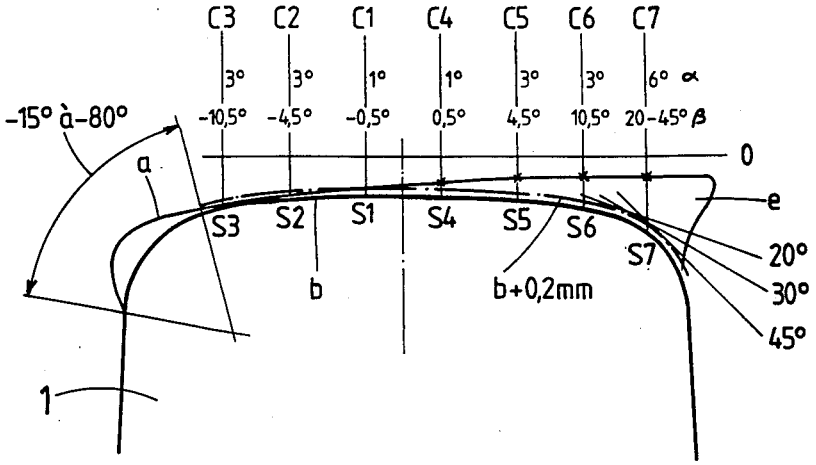
FIG. 6 shows a representation corresponding to that of FIG. 5, to illustrate the measurement and machining of a lap on the rail outer arc.

FIG. 6 illustrates diagrammatically the arrangement of the double grinding heads assigned to the sensors C1 to C6, with an indication of their angle of inclination $\beta$ which they have when aligned with the generatrices s1 to s6, and with an indication of the particular working angle $\alpha$ between their two grinding planes. The negative $\beta$ values refer to the inner half of the rail head. The rail running surface extends on both sides of the mid-perpendicular up to an angle of 15° in each case. FIG. 6 also illustrates diagrammatically the machining of the outer arc of the rail 1 by means of a single sensor C7 indicated merely diagrammatically, which checks the generatrix s7 and which is also indicated in FIG. 3, and by means of a double grinding head which is aligned with the generatrix s7 and of which the $\alpha$ and $\beta$ values are given and the inclination is adjusted in steps.

The original actual profile is designated by a and the desired profile by b. Dot-and-dash lines also indicate a theoretical rough profile b+0.2 mm which projects above the desired profile b by a height of 0.2 mm and which represents a preliminary profile. When considerable quantities of material are to be removed, in fact it is recommended first to grind down to this theoretically predetermined rough profile with maximum grinding pressure in a rough-grinding operation and only then continue to grind to the actual desired profile b with reduced grinding pressure.

It is assumed that the inner arc of the rail 1, which extends over an angular sector of −15° to −80° in the rail profile considered as an example here, is machined by means of lateral grinding wheels according to the known process mentioned. According to FIG. 6 in the profile under consideration the following settings apply in the machining of the rail running surface: $\beta=0.5°$ or $-0.5°$ and $\alpha=1°$ for the double grinding heads aligned with the generatrices s1 and s4; $\beta=4.5°$ or $-4.5°$ and $\alpha=3°$ for the double grinding heads aligned with the generatrices s2 and s5, and $\beta=10.5°$ or $-10.5°$ and again $\alpha=3°$ for the double grinding heads aligned with the generatrices s3 and s6. Accordingly, therefore, each half of the rail running surface is approximated by six facets which have the facet inclination angles 0°, 1°, 3°, 6°, 9° and 12°, when, according to FIG. 4 the two grinding heads are symmetrical relative to the center axis of the double grinding head which defines the angle $\beta$.

To check the outer arc, the sensor C7 is set to that generatrix s7 which passes through the point of contact of the 45° tangent to the theoretical rough profile, that is to say is set to that radius which forms an angle of 45° with the mid-perpendicular of the rail. In the double grinding head aligned with this generatrix s7, the two grinding wheels form a working angle $\alpha=6°$ in the example under consideration. This double grinding head is first set to a small angle of inclination $\beta$ of, for example, 20° and in this position machines the lap e until the sensor C7 measures a predetermined intermediate distance, at which the inner grinding wheel lies exactly in a tangential plane to the rough profile. The grinding operation is then interrupted, and the double grinding head is set to angle of inclination $\beta=30°$, whereupon machining is repeated up to a further predetermined intermediate distance, at which the inner grinding wheel once again lies in a tangential plane to the rough profile. In a last grinding step, the angle of inclination $\beta$ amounts to 45°, and in this grinding step the predetermined rough profile is obtained. The above-described grinding operation carried out in steps is now repeated in the region of the sensor C7 with reduced grinding pressure, until the desired profile b is obtained.

It is also possible, of course, to carry out the grinding operation at each angle of inclination $\beta$, until the inner grinding wheel lies directly in the tangential plane to the desired profile, in which case there is therefore no need to use a rough profile.

Each double grinding head is preferably mounted so as to be adjustable over an angular sector of −15° to +45°, that is to say over the entire region of the rail running surface and outer arc, so that, if required, each double grinding head can work along each generatrix. The working angle o can be set to values up to 10° preferably continuously or in steps.

The above-described machining of the outer arc in steps make it possible, by means of a single sensor, to check several pairs of facets generated in succession, and this of course greatly simplifies the installation and reduces the number of sensors required. Furthermore, advantageously six facets are obtained by means of only three grinding steps, so that a good approximation to the desired profile of the outer arc is achieved. In the example according to FIG. 6 under consideration, with the $\alpha$ and $\beta$ values given, the outer arc is approximated by facets with the inclination angles 17°, 23°, 27°, 33°, 42° and 48°.

The above-described machining of the lap e in the region of the rail outer arc can, of course, also be carried out with only one particular grinding wheel which is aligned with the generatrix s7 and the grinding plane of which is set successively to increasing angles of inclination. In this case, the outer arc of the rail is approximated by fewer facets than during machining with a double grinding head, unless the number of steps is increased. In the example under consideration, if the $\beta$ angles given represent the angles of inclination of the grinding wheel, there would be three facets with the inclination angles 20°, 30° and 45° which are all checked by means of the same measuring sensor C7 set to the 45° facet.

Figure 7:
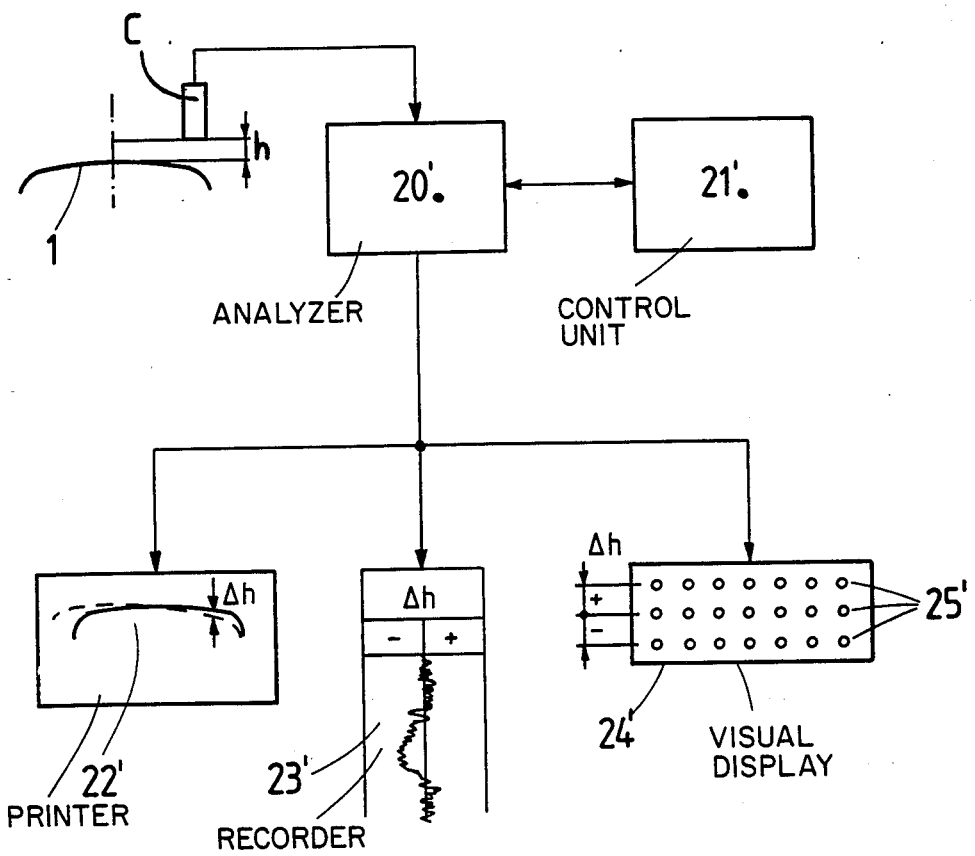
FIG. 7 shows a block diagram of the control and indicator device.

The control and indicator device is described below with reference to FIGS. 7 to 9. According to the block diagram of FIG. 7, this device installed on the rail-grinding car has an analyzer 20', to which the outputs of all the sensors C of the measuring heads are connected and which receives the signals transmitted from these sensors C which represent the respective actual distances h measured. The various theoretical profiles of the rails are stored in this analyzer 20' in the form of the desired distances which there will be between the desired profile of the rail to be machined and the reference line O at the predetermined generatrices.

Figure 8:
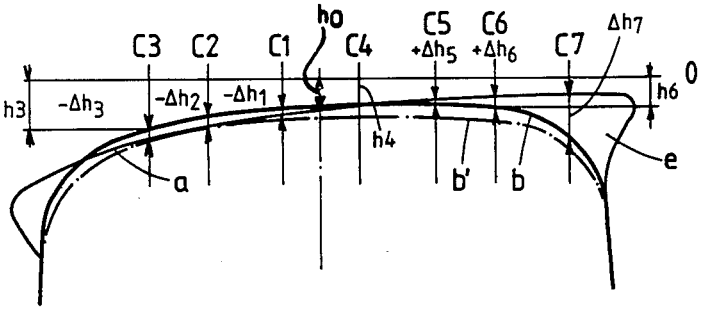
FIG. 8 shows a representation corresponding to that of FIG. 6, to illustrate the machining.
Figure 9:
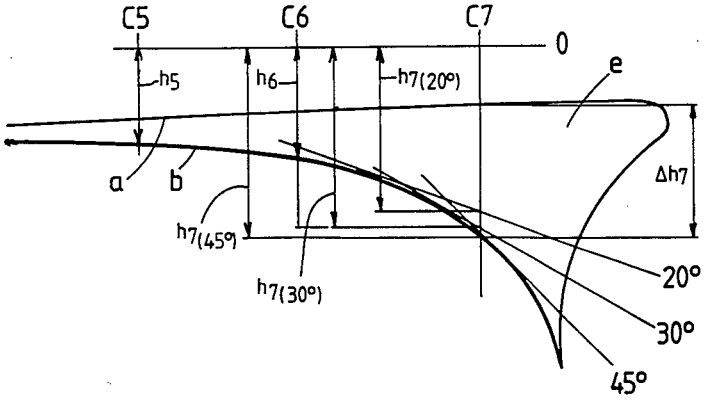
FIG. 9 shows an enlarged representation of the region of the lap according to FIG. 8.

In the example according to FIGS. 8 and 9 under consideration, which corresponds to the example according to FIG. 6, the six desired distances h1 to h6, checked by the sensors C1 to C6, in the region of the rail running surface are stored in the analyzer for the rail to be machined. The desired profile b defined by these desired distances is related to the distance ho which is between the middle generatrix, that is to say the rail axis, and the reference line and which is determined by the sliding blocks 6 (FIG. 3) supported on the center of the rail and by the test-rig structure and therefore naturally remains constant. Of course, at the start of the grinding work there will virtually always be both positive and negative distance differences $\Delta h$ between the desired profile b and the actual profile a, as illustrated in FIG. 8. The final position b' of the desired profile is then, of course, so low that no more negative distance differences occur; the rail center must be ground off over a corresponding width.

For the sake of clarity, in FIG. 8 only the distances h0, h3, h4 and h6 and in FIG. 9 the distances h5 and h6 are designated by reference symbols. As indicated in FIG. 9, for the profile of the outer arc in the region of the sensor C7, the intermediate desired distances h7 (20°) and h7 (30°) and the final desired distance h7 (45°) are stored, specifically for the purpose of carrying out the above-described machining of the outer arc in steps. In the analyzer 20', these stored desired distances are compared with the measured actual distances, and the control commands resulting from this are sent to a control unit 21' which controls the various grinding heads directly, in such a way that each grinding head is automatically lifted off into its inoperative position when the actual distance measured by the respective sensor corresponds to the predetermined desired distance.

Furthermore, in the example under consideration, a printer 22', a recorder 23' and a visual display 24' are connected to the analyzer 20'. In practice, however, it is sufficient if at least one of these indicator instruments is installed.

The printer 22' draws the particular measured actual profile on the basis of the measured actual distances and makes it possible to obtain a visual comparison with the desired profile by giving the distance difference for each generatrix. Since the profile changes are directly influenced by the track geometry and generally never occur abruptly, it is sufficient to record the profiles only every 20, 50 or 100 m, and this can be done automatically; t is also possible, if required, for the attendant to call up the profile recordings by hand, for example at each change of the profile, such as, for example, before, in the middle of or after a transition curve, and every 100 m in a full curve or on a straight stretch. This printer is very useful, above all during work preparation, when the profiles are recorded before the grinding operation, because the attendant is thus able in a relatively simple way to draw up a special grinding program for each specific track section.

The recorder 23' records the distance differences $\Delta h$ for each sensor as a function of the path covered, and as already mentioned these distance differences can initially be positive or negative. In the example according to FIGS. 8 and 9, the distance differences $\Delta h5$, $\Delta h6$ and $\Delta h7$ are positive and the distance differences $\Delta h1$, $\Delta h2$ and $\Delta h3$ are negative, whilst the distance difference $\Delta h4$ practically disappears. This recording of the $\Delta h$ values by the recorder 23' makes it possible to detect the longitudinal waves of the rail along a generatrix and, by comparing the recordings along all the generatrices, also ascertain the possible transverse waves. Measures for compensating the longitudinal waves of the rail do not belong to the subject of the present invention and can be taken into account in the known way, as described, for example, in German Patent Specification No. 2,843,649 of the same applicant. It is pertinent that the recording of the distance differences along the generatrices makes it possible to detect the rail waves accurately, which is not directly possible in the hitherto known proposed recordings of the rail-head profile.

The visual display 24' has three rows of signal lamps 25' which are arranged in the form of a matrix and of which the number of columns corresponds to the number of generatrices checked. The arrangement is such that the signal lamps of the upper row light up when and as long as the distance difference of the particular generatrix is positive, and the signal lamps of the lower row light up when and as long as the distance difference of the particular generatrix is negative, the signal lamps of the middle row only lighting up when the actual distance of the generatrix corresponds to the desired distance within the admissible tolerances. Appropriately, red lamps are provided for the upper and lower rows and green lamps for the middle row. Thus, because three signal lamps are assigned to each sensor, it is possible in a simple way and at a glance to monitor the particular actual state of the profile and ascertain along which generatrix material still has to be removed. To prevent the lamps from constantly flashing, especially when the actual profile approaches the desired profile, the analyzer can control the signal lamps so that the lamps are switched on only every 20, 50 or 100 m according to the mean distance difference measured in this interval.

By means of the control device described, the relatively large number of information items, that is to say distance values, which the sensors supply is automatically processed practically instantaneously and used for the automatic control of the grinding heads. At the same time, both measurement and evaluation are very simple, since only distances are measured and the control is carried out on the basis of distances. There is therefore no need to measure other characteristic quantities of the rail profile, such as, for example, angles, or evaluate them on the basis of the measurement data in a special computing circuit. In principle, the grinding speed, the grinding pressure or the advancing speed of the rail-grinding car are just as unimportant for obtaining the desired profile, since the profile is checked and obtained merely on the basis of a comparison between the desired values and actual values of the distances of the selected generatrices. The control of the grinding force and of the grinding speed simply serves to carry out the grinding operations efficiently and quickly.

In addition to storing the desired distances in the analyzer, it is of course necessary to predetermine and set the values of the above-mentioned angles of inclination $\beta$ of the double grinding heads and of the above-mentioned working angles $\alpha$ of the two grinding wheels of each double grinding head according to the desired rail profile, these values being dependent on the generatrix along which grinding is carried out.

In a semi-automatic control, the attendant, on the basis of observations of the indicator devices, aligns the double grinding heads with the respective generatrices by adjusting their angle of inclination and sets their two grinding heads to the working angle $\alpha$ assigned to the particular generatrix. To make it easier to carry out this control by hand, each grinding-head carrier is equipped with a working-angle indicator and with a selector which makes it possible to set the grinding-head carrier exactly to one of the generatrices.

The grinding operation is carried out first with large positive distance differences on the generatrices and, if negative distance differences appear, in the middle region of the running surface until the test rig with the sliding block 6 has descended so far that all the negative distance differences disappear. In the example according to FIGS. 6, 8 and 9, all the double grinding heads are first set to the generatrices s5 to s7, and the work is carried out at the maximum grinding pressure until the rough profile b+0.2 mm, indicated in FIG. 6, is obtained. Then, for fine machining, the double grinding heads are distributed to all the generatrices where the distance difference is positive, a double grinding head being lifted off automatically into its inoperative position when it is set to a generatrix which has a negative or a vanishing distance difference. The work is then continued with a reduced grinding pressure until the desired profile b is obtained. Preferably, the grinding force is therefore controlled in steps or continuously as a function of the thickness of the material to be removed. Also, as soon as the desired profile has been obtained along one or more generatrices, all the grinding-head carriers can be set manually or automatically to those generatrices on which material still has to be removed. This makes the grinding operation more efficient, because all the grinding heads can always be used effectively. At all events, the grinding operation is automatically interrupted on a generatrix, as soon as the distance difference vanishes.

However, the grinding operation can also be carried out fully automatically. In this case, the respective $\alpha$ and $\beta$ values are stored in the analyzer, and the analyzer 20' and the control unit 21 also supply control commands, by means of which the double grinding heads are automatically aligned with the generatrices to be ground, the particular working angle $\alpha$ likewise being set automatically at the same time. A control program of this type can be organized, for example, in such a way that all the grinding heads can be concentrated on the generatrices s6 and s7 in the first grinding pass and on the generatrices s5 to s7 subsequently, until the rough profile b+0.2 mm is obtained. At the same time, the grinding force is adjusted continuously as a function of the thickness of the material still to be removed. Subsequently, fine machining is then carried out, and in this the double grinding heads are aligned automatically with the various generatrices and operated with a reduced grinding force, until the desired profile b is obtained.

For the sake of completeness, it should be mentioned that the remachining of rail-head profile practically always has to be carried out in a larger number of work cycles, because, in each pass, only a relatively small quantity of material merely corresponding to a fraction of the total thickness of material to be removed can ever be ground off. In the approach to the desired profile when the work is carried out with a reduced grinding pressure, generally only a tenth or a few tenths of a millimeter are removed in each pass. The rail-grinding car therefore has to travel several times over the rail section to be machined, grinding preferably taking place during both each outgoing run and each return run. It is therefore sufficient if, according to the present invention, only one test rig with measuring sensors is used, this being installed at one end of the rail-grinding car or the other. Thus, depending on whether the test rig is located at the front or the rear end of the car, as seen in the direction of advance, in each grinding pass a measurement is only made either directly in front of or directly behind the grinding heads, this being fully adequate to measure the particular actual profile with sufficient accuracy.

By means of the process and the device according to the invention, therefore, on the one hand the measurement of the actual profile merely involves simple distance measurements, without complicated profile parameters having to be measured or calculated, and likewise the profile machining is simply controlled on the basis of a comparison between desired and actual distance values. On the other hand, the invention makes it possible to check double the number of facets by means of a specific number of sensors, so that a profile approximating the desired profile as closely as possible can be produced with relatively few sensors.

The invention is not restricted to the exemplary embodiment described, but admits of many alternative forms, above all with regard to the constructive design of the adjustable double grinding heads. Furthermore, for example, more than one pair of grinding heads, that is to say more than one double grinding head, can be installed in a common grinding-head carrier, so that any two or more double grinding heads can be jointly set to a generatrix by adjusting their grinding-head carrier. Also, in principle, mechanical tracers known per se, which rest on the rail, can be used as measuring sensors for distance measurement. Of course, the above-described control by means of a simple comparison between desired and actual distance values can also be used when the actual distances to each individual facet, especially to the center of each facet, are measured and accordingly a measuring sensor checks only one particular facet and the rail-grinding car operates with individually adjustable grinding heads.

I claim:

1. A process of measuring and grinding the profile of a rail head which comprises simultaneously grinding several facets of the rail head by a plurality of grinding wheels disposed at different predetermined angles of inclination to correspond to the desired profile, continuously measuring distances from a reference base defined by a measuring frame to several generatrices distributed over the profile of the rail head as actual values to determine the actual profile, comparing actual measured values with predetermined desired values during the grinding operation and lifting each of said grinding wheels off to an inoperative position whenever a facet ground by said grinding wheel reaches a position corresponding to the desired distance value in relation to said reference base.

2. A process according to claim 1, wherein adjacent facets of said rail head are ground by two grinding wheels of a double grinding head, the grinding planes of said grinding wheels forming a predetermined working angle with one another which corresponds to the desired profile and wherein said measured distance comprise a distance from said reference base to a vertex line defined by the intersection of planes of said pair of facets, the value of said measured distance being compared with a predetermined desired value of the distance between said vertex line and the measuring base.

3. A process according to claim 2, wherein, in grinding a lateral lap of said rail head, the distance from said reference base to the rail surface is measured by means of only one measuring sensor along a predetermined generatrix, and wherein the grinding operation in the region of this generatrix is carried out by means of at least one grinding wheel in several successive grinding steps, said grinding wheel being oriented differently in each of said grinding steps in the manner that the angle of inclination of the grinding plane is increased after each of said grinding steps, grinding being interrupted when the distance between said generatrix and said reference base reaches a predetermined intermediate desired value at which he facet ground forms at least approximately a tangential plane to the desired profile of the rail head, whereupon said grinding wheel is set to an increased angle of inclination and grinding is resumed.

4. A process according to claim 3, wherein said stepwise grinding of said lap is carried out by means of a double grinding head having two grinding wheels, the grinding planes of which form a predetermined working angle with one another.

5. A process according to claim 3, wherein said measuring sensor is set approximately at a 45° tangent and wherein during each grinding step the angle of inclination of the grinding plane is adjusted by 10° to 15°.

6. A process according to claim 1, wherein, when the thickness of the material to be removed is greater than about 0.2 mm, grinding is first carried out with a high grinding force until an intermediate desired profile is obtained and subsequently a precision grinding operation is carried out with a reduced grinding force until the final desired profile is obtained.

7. A process according to claim 1, wherein grinding wheels the grinding planes of which reach the desired distance from the reference base, are thereupon shifted to another genertrix along which the desired distance from the reference base has not yet been reached.

8. A rail-grinding car for measuring and grinding the profile of a rail head, comprising a measuring frame, a plurality of grinding heads adjustably mounted on said measuring frame for height and inclination adjustment, a plurality of sensors mounted on said measuring frame for measuring the actual distance between respective generatrices of the surface of said rail head and a reference base established by said measuring frame, means for controlling the height and inclination adjustment of said grinding heads, said control means comprising an analyzer which receives outputs of all of said sensors, stores, desired values of distances of all generatrices of said rail head surface, compares actual distances measured by said sensors with corresponding stored desired values and controls a control unit for lifting grinding heads to inoperative position when measured distance to the generatrix ground by the respective grinding head reaches the desired value.

9. A rail-grinding car according to claim 8, wherein said grinding heads comprise at least one double grinding head having two grinding wheels, said double grinding head being mounted pivotably on said measuring frame for alignment with a selected generatrix of said rail head surface, and wherein said grinding wheels are pivotable relative to one another and are adjustably angularly to grind pairs of adjacent facets of said rail head surface in one grinding operation, said grinding wheels being angularly adjustable so that their respective grinding planes form a predetermined working angle corresponding to the desired profile of said rail head surface.

10. A rail-grinding car according to claim 9, wherein said analyzer and said control unit are operable to align the grinding heads with the generatrices to be ground and to control the grinding force as a function of the thickness of material to be removed.

11. A rail-grinding car according to claim 10, wherein said analyzer and said control unit are operable to adjust the grinding heads to the desired angle of inclination.

12. A rail-grinding car according to claim 9, wherein said analyzer and said control unit are operable to adjust the working angle of said grinding wheels of a double grinding head as a function of the generatrix with which said double grinding head is aligned.

13. A rail-grinding car according to claim 8, further comprising indicator means connected with said analyzer and comprising a printer for recording the actual profile and the desired profile and for indicating differences between measured values and desired values.

14. A rail-grinding car according to claim 8, further comprising a recorder connected with said analyzer for continuously recording positive and negative differences between measured distances and desired distances.

15. A rail-grinding car according to claim 8, further comprising visual means connected with said analyzer and comprising lamps which are arranged in the form of a matrix and which indicate for each generatrix whether the difference between the measured distance and the desired distance is positive, negative or zero.

* * * * *